United States Patent [19]

Carrico

[11] Patent Number: 4,719,911

[45] Date of Patent: Jan. 19, 1988

[54] AIR FILTER MASK WITH MOUTH RETENTION MEANS

[76] Inventor: George L. Carrico, 6195 Gregory Dr., Indianapolis, Ind. 46241

[21] Appl. No.: 920,732

[22] Filed: Oct. 20, 1986

[51] Int. Cl.[4] ..... A62B 18/08

[52] U.S. Cl. ..... 128/206.29; 128/206.12; 128/206.19

[58] Field of Search ..... 128/206.19, 206.12, 128/206.14, 206.25, 206.29, 139, 136

[56] References Cited

U.S. PATENT DOCUMENTS

| | | | |
|---|---|---|---|
| 2,012,505 | 8/1935 | Goldsmith . | |
| 2,521,084 | 9/1950 | Oberto . | |
| 2,566,557 | 9/1951 | Danielson | 128/139 |
| 2,839,053 | 6/1958 | Lorenz . | |
| 2,995,131 | 8/1961 | Elam . | |
| 3,020,911 | 2/1962 | Girden . | |
| 3,027,896 | 4/1962 | Newton . | |
| 3,037,501 | 6/1962 | Miller . | |
| 3,139,088 | 6/1964 | Galleher, Jr. . | |
| 3,207,154 | 9/1965 | Rubilotta . | |
| 3,220,409 | 11/1965 | Liloia et al. . | |
| 3,603,315 | 9/1971 | Becker, III . | |
| 3,620,214 | 7/1969 | Thackston . | |
| 3,695,265 | 10/1972 | Brevik | 128/206.14 |
| 3,809,079 | 5/1974 | Buttaravoli . | |
| 3,939,830 | 2/1976 | da Costa . | |
| 3,991,236 | 5/1963 | Delbert . | |
| 3,991,753 | 11/1976 | Viesca y Viesca . | |
| 4,029,092 | 6/1977 | Morgan . | |
| 4,098,270 | 7/1978 | Dolby . | |
| 4,231,359 | 11/1980 | Martin . | |
| 4,250,577 | 2/1981 | Smith . | |
| 4,296,746 | 10/1981 | Mason, Jr. et al. . | |
| 4,384,577 | 5/1983 | Huber . | |
| 4,470,413 | 9/1984 | Warncke . | |
| 4,573,463 | 3/1986 | Hall . | |
| 4,580,556 | 4/1986 | Kondur . | |

FOREIGN PATENT DOCUMENTS

| | | | |
|---|---|---|---|
| 829908 | 4/1938 | France | 128/206.29 |

*Primary Examiner*—Edward M. Coven
*Assistant Examiner*—J. P. Lacyk
*Attorney, Agent, or Firm*—Woodard, Emhardt, Naughton Moriarty & McNett

[57] ABSTRACT

An air filter mask with a cup-shaped air-permeable filter element having a perimetrical edge which fits against the face of the person circumjacent the nose and mouth such that substantially all of the air breathed by the person passes through the filter element. A mouthpiece configured to be received and gripped between the upper lip and the upper teeth and gums of the person is attached to a shaft configured to extend outwardly from the mouth between the lips of the person. A pair of annular retainers are disposed about the shaft in slidable frictional engagement therewith, one on each side of the filter element for engaging the filter element therebetween and retaining the filter element in a selected position with respect to the shaft.

10 Claims, 5 Drawing Figures

AIR FILTER MASK WITH MOUTH RETENTION MEANS

BACKGROUND OF THE INVENTION

1. Field of the Invention:

The invention relates in general to air filter masks intended to be worn on a person's face over the nose and mouth for the purpose of preventing the inhalation or exhalation of particulates and bacteria, and in particular to a filter mask which is retained in place by means received in the mouth of the person.

2. Description of the Related Art:

Filter masks of various constructions and compositions are worn by health care workers over the nose and mouth for the purpose of permitting free breathing while avoiding the spread of disease by air-borne particles transmitted from the worker to patients vulnerable to infection, and from infectious patients to the worker. Such masks include, among others, flexible cloth-like masks retained in place by tie strings about the head, and semi-rigid self-supporting masks molded of a fibrous material and retained by an elastic cord about the head. Because of their means of retention, the aforementioned masks cannot be readily and repeatedly removed and replaced in quick succession.

There are certain situations where it would be desirable to have an air filter mask which can be put on quickly as needed, and likewise removed quickly when not needed. An example of such a situation is where a dentist is working in the mouth of a patient with his own face in close proximity thereto, during which time it is desirable for the dentist to wear a mask to avoid air borne particle transmission between patient and dentist. Periodically, the dentist may stop working in the mouth and move away from the patient, during which time he may wish to remove his mask to facilitate more natural conversation with the patient, which helps to put the patient at ease.

An air filter mask in accordance with the present invention can be quickly put on and removed, because it does not depend upon tie strings or elastic cords to retain it in place, as do conventional air filter masks. Rather, the filter element is retained by means received and gripped within the mouth of the wearer. More specifically, the mouth retention means is received between the upper lip and the upper teeth and gums, which permits the lower jaw to be moved sufficiently to permit talking even with the mask in place, without jeopardizing the security of the mask's retention.

SUMMARY OF THE INVENTION

An air filter mask to be worn by a person, includes a cup-shaped air-permeable filter element having a perimetrical edge adapted and configured to fit against the face of the person circumjacent the nose and mouth such that substantially all of the air breathed by the person passes through the filter element. A retention means adapted to be received in the mouth of the person is provided for retaining the filter element in position against the face while permitting lower jaw movement sufficient for talking. The retention means includes a mouthpiece adapted and configured to be received and gripped between the upper lip and the upper teeth and gums of the person, a shaft attached to the mouthpiece and configured to extend outwardly from the mouth between the lips of the person, and means for attaching the filter element to the shaft such that the perimetrical edge of the filter element fits against the face of the person circumjacent the nose and mouth when the mouthpiece is received and gripped between the upper lip and the upper teeth and gums of the person.

It is an object of the present invention to provide an air filter mask having an improved retention means which allows the mask to be quickly removed and replaced as desired.

Further objects and advantages will become apparent from the following descriptions.

DESCRIPTION OF THE PREFERRED EMBODIMENT

Figure 1:
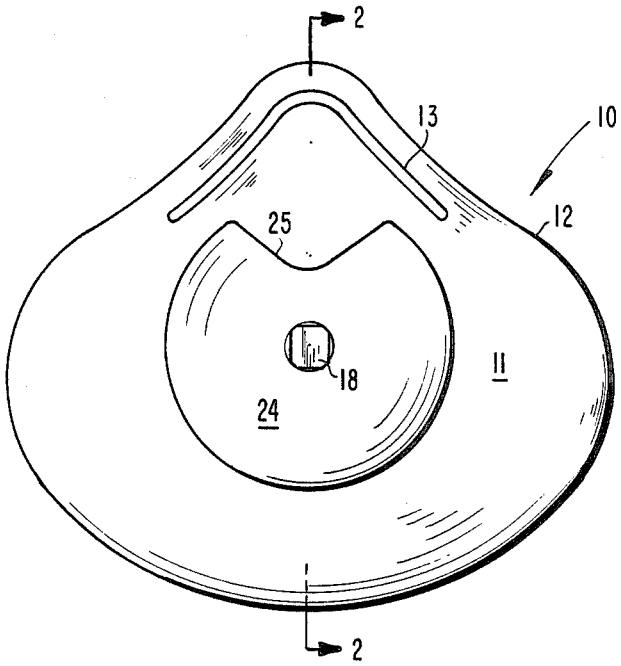
FIG. 1 is a front elevational view of an air filter mask in accordance with the present invention.

For the purposes of promoting an understanding of the present invention, reference will now be made to the embodiment illustrated in the drawings and specific language will be used to describe the same. It is nevertheless to be understood that no limitation of the scope of the invention is thereby intended, the proper scope of the invention being indicated by the claims appended below and the equivalents thereof.

Figure 2:
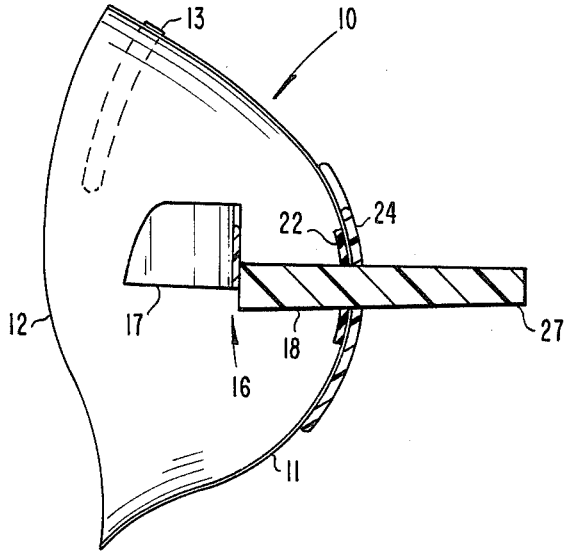
FIG. 2 is a sectional view of the air filter mask of FIG. 1, taken along line 2—2.
Figure 3:
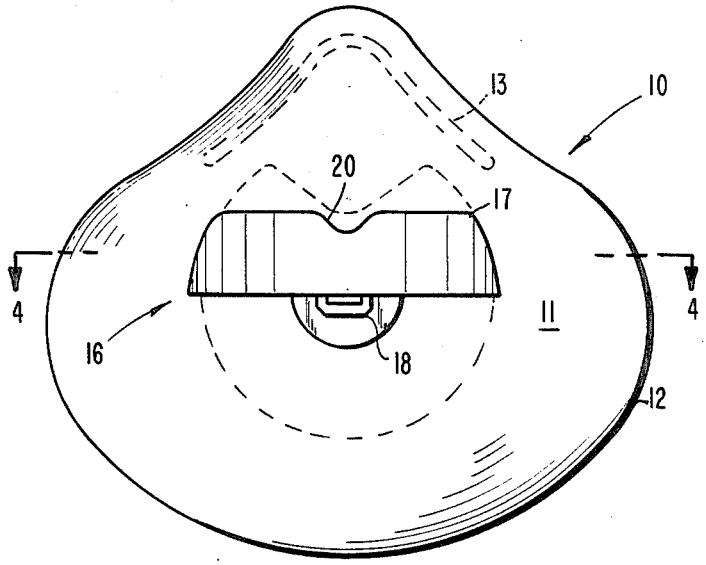
FIG. 3 is a rear elevational view of the air filter mask of FIG. 1.
Figure 4:
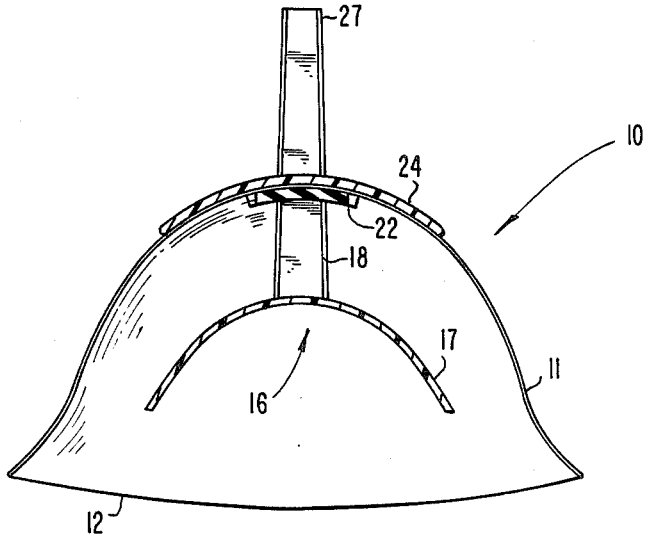
FIG. 4 is a sectional view of the air filter mask of FIG. 1, taken along line 4—4 of FIG. 3.
Figure 5:
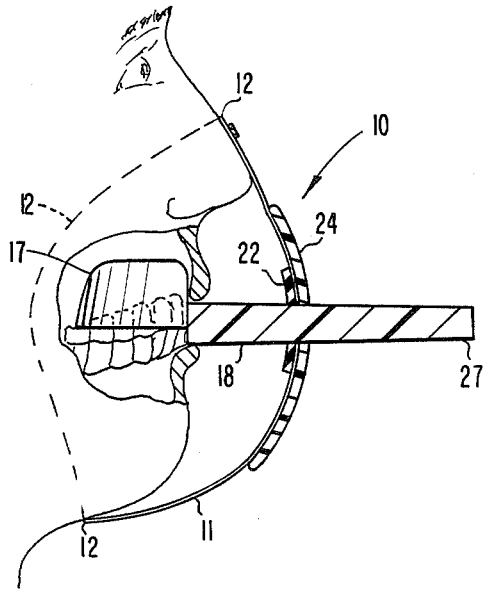
FIG. 5 is a partial sectional view of the air filter mask of FIG. 1, shown in relationship to a person, and particularly showing the relationship between the mouthpiece and the teeth and gums.

Referring to FIGS. 1–5, there is illustrated an air filter mask 10, which includes a cup-shaped air-permeable filter element 11 which has a perimetrical edge 12 shaped to fit against the face of a person circumjacent the nose and mouth such that the air breathed by the person is constrained to pass through the filter element 11. Filter element 11 is preferably molded of fibrous material and is of sufficient stiffness to be self-supporting, yet of sufficient flexibility to conform to various facial shapes so as substantially prevent air leakage about the perimetrical edge 12. A bendable metal strip 13 is adhesively attached to the outer surface of filter element 11 at a location which overlies the nose of the person when filter mask 10 is being worn. Metal strip 13 can be bent to conform to the shape of the face in the vicinity of the nose, thereby holding the adjacent perimetrical edge 12 close to the face, which helps prevent air leaks, and also helps prevent fogging of the wearer's glasses, if he is wearing such.

A retention means 16 is adapted to be received in the mouth of the person for retaining filter element 11 in position against the face, and is further adapted to permit lower jaw movement sufficient to enable talking while the mask is in place. Retention means 16 includes as its principal elements a U-shaped mouthpiece 17 adapted to be received and gripped between the upper lip and the upper teeth and gums of the person, and a shaft 18 which is attached to the mouthpiece and configured to extend outwardly from the mouth between the lips of the person. Mouthpiece 17 is of substantially uniform height except for a cut-out 20 at the upper center to accommodate the frenulum of the upper lip.

Filter element 11 is attached to shaft 18 such that the perimetrical edge 12 of filter element 11 fits against the face circumjacent the nose and mouth when mouthpiece 17 is received in its proper orientation in the mouth. Shaft 18 is received through an appropriately sized centrally located aperture in filter element 11, and extends outwardly therebeyond sufficiently to provide a handle grip portion 27 exterior of filter element 11 configured to be grasped by the hand of the wearer to facilitate handling of air filter mask 10. A pair of annular retainers 22 and 24 are disposed about shaft 18 in slidable frictional engagement therewith, one on each side of filter element 11 for engaging filter element 11 therebetween. Retainers 22 and 24 can be slid along shaft 18 to provide for user adjustment of the distance between mouthpiece 17 and filter element 11. Retainers 22 and 24 are preferably constructed of a synthetic plastic material which is elastically deformable so as to grip shaft 18 and remain in the selected position therealong, yet be easily movable when desired. Outer retainer 24 is impermeable and of a diameter sufficiently large to provide a guard against contact between the wearer's hand and filter element 11 upon handling of handle grip portion 27. This helps prevent contamination of filter element 11 should the wearer's fingers have saliva or other contaminants on them. Outer retainer 24 is provided with a cut-out 25 to accommodate the nose. The components of retention means 16 are preferably made of materials which are non-allergenic. Such components can either be made of materials which can be readily sterilized, permitting their repeated reuse, with filter element 11 being disposable and replaceable, or alternatively, they can be made of inexpensive materials so that the entire retention means and mask can be disposed of after each use, with the economics and efficacy of sterilization determining the preferred approach.

Inasmuch as mouthpiece 17 is received and gripped between the upper teeth and gums and the upper lip only, the lower teeth and lower lip are not required to retain air filter mask 10 in place against the face. Consequently, the lower jaw is free to move sufficiently to permit talking, to the same extent that the jaw would be free to move with a conventional air filter mask retained in place by ties or elastic around and behind the head.

While the preferred embodiment of the invention has been illustrated and described in some detail in the drawings and foregoing description, it is to be understood that this description is made only by way of example to set forth the best mode contemplated of carrying out the invention and not as a limitation to the scope of the invention which is pointed out in the claims below.

What I claim is:

1. An air filter mask to be worn by a person, comprising:

a cup-shaped air permeable filter element having a perimetrical edge adapted and configured to fit against the face of the person circumjacent the nose and mouth such that substantially all of the air breathed by the person passes through the filter element; and retention means adapted to be received in the mouth of the person for retaining said filter element in position against the face while permitting lower jaw movement sufficient for talking, said retention means including:

a mouthpiece adapted and configured to be received and gripped between the upper lip and the upper teeth and gums of the person, a shaft attached to the mouthpiece and configured to extend outwardly from the mouth between the lips of the person, and means for attaching said filter element to the shaft such that the perimetrical edge of said filter element fits against the face of the person circumjacent the nose and mouth when said mouthpiece is received and gripped between the upper lip and the upper teeth and gums of the person, said means for attaching being adjustable to provide for user adjustment of the distance between the mouthpiece and the filter element, and including an aperture defined by said filter element and sized to receive the shaft therethrough, and a pair of annular retainers disposed about the shaft in slidable frictional engagement therewith, one on each side of the filter element for engaging the filter element therebetween and retaining the filter element in a selected position with respect to the shaft.

2. The air filter mask of claim 1, in which the shaft is of sufficient length to provide a handle grip portion exterior of said filter element configured to be grasped by the hand of the person to facilitate handling.

3. The air filter mask of claim 2, in which the annular retainer on the exterior side of the filter element is impermeable and of sufficiently large diameter to provide a guard against contact between the hand of the person and the filter element upon handling of the handle grip portion.

4. The air filter mask of claim 3, in which the annular retainer on the exterior side of the filter element is of greater rigidity than the filter element and is generally conformed thereto to provide dimensional reinforcement of the filter element.

5. A retainer for retaining against the face of a person a cup-shaped air permeable filter element having an aperture therethrough and a perimetrical edge configured to fit against the face of the person circumjacent the nose and mouth, comprising:

a mouthpiece configured to be received and gripped between the upper lip and the upper teeth and gums of the person;

a shaft attached to the mouthpiece and configured to extend outwardly from the mouth between the lips of the person to be received through the aperture of the filter element, and sized and configured with respect to the aperture to substantially prevent air passage through the aperture; and a pair of annular retainers disposed about the shaft, in slidable frictional engagement therewith, for engaging the filter element therebetween and retaining the filter element in a selected position with respect to the shaft, thereby providing for user adjustment of the distance between the mouthpiece and the filter element.

6. The retainer of claim 5, in which the shaft is of sufficient length to provide a handle grip portion exterior of said filter element configured to be grasped by the hand of the person to facilitate handling.

7. The retainer of claim 6, in which the annular retainer on the exterior side of the filter element is impermeable and of sufficiently large diameter to provide a guard against contact between the hand of the person and the filter element upon handling of the handle grip portion.

8. The retainer of claim 7, in which the annular retainer on the exterior side of the filter element is of greater rigidity than the filter element and is generally conformed thereto to provide dimensional reinforcement of the filter element.

9. The retainer of claim 5, in which the mouthpiece is generally U-shaped.

10. The retainer of claim 9, in which the U-shaped mouthpiece is of substantially uniform height except for a cut-out at the upper center to accommodate the frenulum of the upper lip.

* * * * *